US011663909B1

(12) United States Patent
Schlueter

(10) Patent No.: US 11,663,909 B1
(45) Date of Patent: May 30, 2023

(54) TRAFFIC JAM AVOIDANCE SYSTEM THAT ASSIGNS VEHICLES TO LANES BASED ON DRIVER COMFORT LEVELS

(71) Applicant: Georg Schlueter, San Marcos, CA (US)

(72) Inventor: Georg Schlueter, San Marcos, CA (US)

(73) Assignee: HansaTekNetics LLC

( * ) Notice: Subject to any disclaimer, the term of this patent is extended or adjusted under 35 U.S.C. 154(b) by 0 days.

(21) Appl. No.: 18/067,682

(22) Filed: Dec. 16, 2022

(51) Int. Cl.
*G08G 1/01* (2006.01)
*G08G 1/0967* (2006.01)

(52) U.S. Cl.
CPC ..... *G08G 1/0141* (2013.01); *G08G 1/0112* (2013.01); *G08G 1/0145* (2013.01); *G08G 1/096725* (2013.01)

(58) Field of Classification Search
None
See application file for complete search history.

(56) References Cited

U.S. PATENT DOCUMENTS

| | | | | |
|---|---|---|---|---|
| 9,672,734 | B1 * | 6/2017 | Ratnasingam | H04W 4/44 |
| 2018/0374346 | A1 * | 12/2018 | Fowe | G08G 1/0112 |
| 2020/0003577 | A1 * | 1/2020 | Kline | G01C 21/3602 |
| 2020/0082716 | A1 * | 3/2020 | Britt | G01C 21/3492 |
| 2021/0049373 | A1 * | 2/2021 | Vladimerou | G06V 20/56 |

* cited by examiner

*Primary Examiner* — Navid Z. Mehdizadeh
(74) *Attorney, Agent, or Firm* — Arc IP Law, PC; Joseph J. Mayo

(57) ABSTRACT

A traffic management system that assigns vehicles to lanes of a multi-lane road based on a measured driver comfort level (DCL) factor associated with each vehicle that reflects how comfortable the vehicle's driver is with shorter following distances at high speeds. An illustrative DCL may be defined as the square of the vehicle's velocity divided by the inter-vehicle spacing. By preventing high DCL drivers from mixing with low DCL drivers on the same lane, the system improves traffic flow and stability and reduces the likelihood of traffic jams. The system may obtain vehicle velocity and following distance data from vehicle sensors and use this data to calculate a vehicle's DCL. When a vehicle enters a roadway managed by the system, the system obtains the vehicle's DCL and transmit a message to the vehicle's navigation system to guide the vehicle to the desired lane.

12 Claims, 10 Drawing Sheets

TRAFFIC JAM AVOIDANCE SYSTEM THAT ASSIGNS VEHICLES TO LANES BASED ON DRIVER COMFORT LEVELS

BACKGROUND OF THE INVENTION

Field of the Invention

One or more embodiments of the invention are related to the field of traffic control systems for vehicles on roadways. More particularly, but not by way of limitation, one or more embodiments of the invention enable a traffic jam avoidance system that assigns vehicles to lanes based on driver comfort levels.

Description of the Related Art

Freeway congestion is a serious and increasing problem with enormous costs to society and to drivers. Because of the limitations and errors of human drivers, today's traffic configurations tend to break down under elevated traffic loads resulting in excessively long travel times. Existing traffic management solutions such as carpool lanes and traffic metering have had relatively limited effect on congestion. Moreover, these existing solutions do not take advantage of the capabilities of modern vehicles, which are generally equipped with multiple sensors and control systems. There are no known systems that obtain data from vehicles to characterize the behavior of individual drivers, and that then use that data to manage the flow of traffic on roadways.

For at least the limitations described above there is a need for a traffic jam avoidance system that assigns vehicles to lanes based on driver comfort levels.

BRIEF SUMMARY OF THE INVENTION

One or more embodiments described in the specification are related to a traffic jam avoidance system that assigns vehicles to lanes based on driver comfort levels. Embodiments of the invention may calculate a driver comfort level (DCL) factor for a vehicle based on data measured by the vehicle's sensors, and may guide the vehicle to a specific lane that is appropriate for that vehicle's measured DCL.

One or more embodiments of the invention may include one or more processors that are coupled via a network to multiple vehicles. Each vehicle may have a velocity sensor that measures the vehicle's velocity, a distance sensor that measures the following distance between the vehicle and another vehicle immediately in front of it, and a navigation system that provides navigation messages to the vehicle. The processors may collect sample data pairs from each vehicle while the vehicle is moving on one or more roadways, where a sample data pair includes the vehicle's velocity and the vehicle's following distance. They may calculate a driver comfort level for each vehicle from the sample data pairs, and store the driver comfort level for each vehicle in a memory. The processors may manage lane assignments on a multi-lane road based on the driver comfort levels. Managing lane assignments may include assigning a driver comfort level range to two or more lanes of the multi-lane road, where the driver comfort level ranges of different lanes do not overlap. For each vehicle moving on this multi-lane road, the processors may retrieve the driver comfort level associated with the vehicle from the memory, select an assigned lane with an associated driver comfort level range that contains the vehicle's driver comfort level, and transmit a message to the vehicle's navigation system instructing the vehicle to drive in the assigned lane.

In one or more embodiments, calculation of a vehicle's driver comfort level may include selecting at least one sample data pair that represents a minimum following distance at a maximum velocity, calculating vehicle spacing for the selected sample data pairs as the following distance plus a vehicle length, and calculating the driver comfort level as the square of the velocity divided by the vehicle spacing.

In one or more embodiments higher driver comfort level ranges may be assigned to lanes closer to the center of a multi-lane road.

In one or more embodiments the processors may also assign a lane velocity to two or more lanes of a multi-lane road. In one or more embodiments a higher velocity may be assigned to lanes with higher DCL ranges. In one or more embodiments the processors may send a second message to the navigation system of each vehicle instructing it to drive at the lane velocity associated with its assigned lane.

In one or more embodiments the vehicles may also have a cruise control system. The cruise control system may receive a target driver comfort level from the processor(s). It may obtain the vehicle's velocity from the velocity sensor, obtain the following distance from the distance sensor, calculate vehicle spacing as the sum of the following distance and a vehicle length, calculate an actual driver comfort level as the ratio of the velocity squared to the vehicle spacing, and adjust the vehicle velocity to maintain the actual driver comfort level with a range near the target driver comfort level.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION OF THE INVENTION

A traffic jam avoidance system that assigns vehicles to lanes based on driver comfort levels will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1:
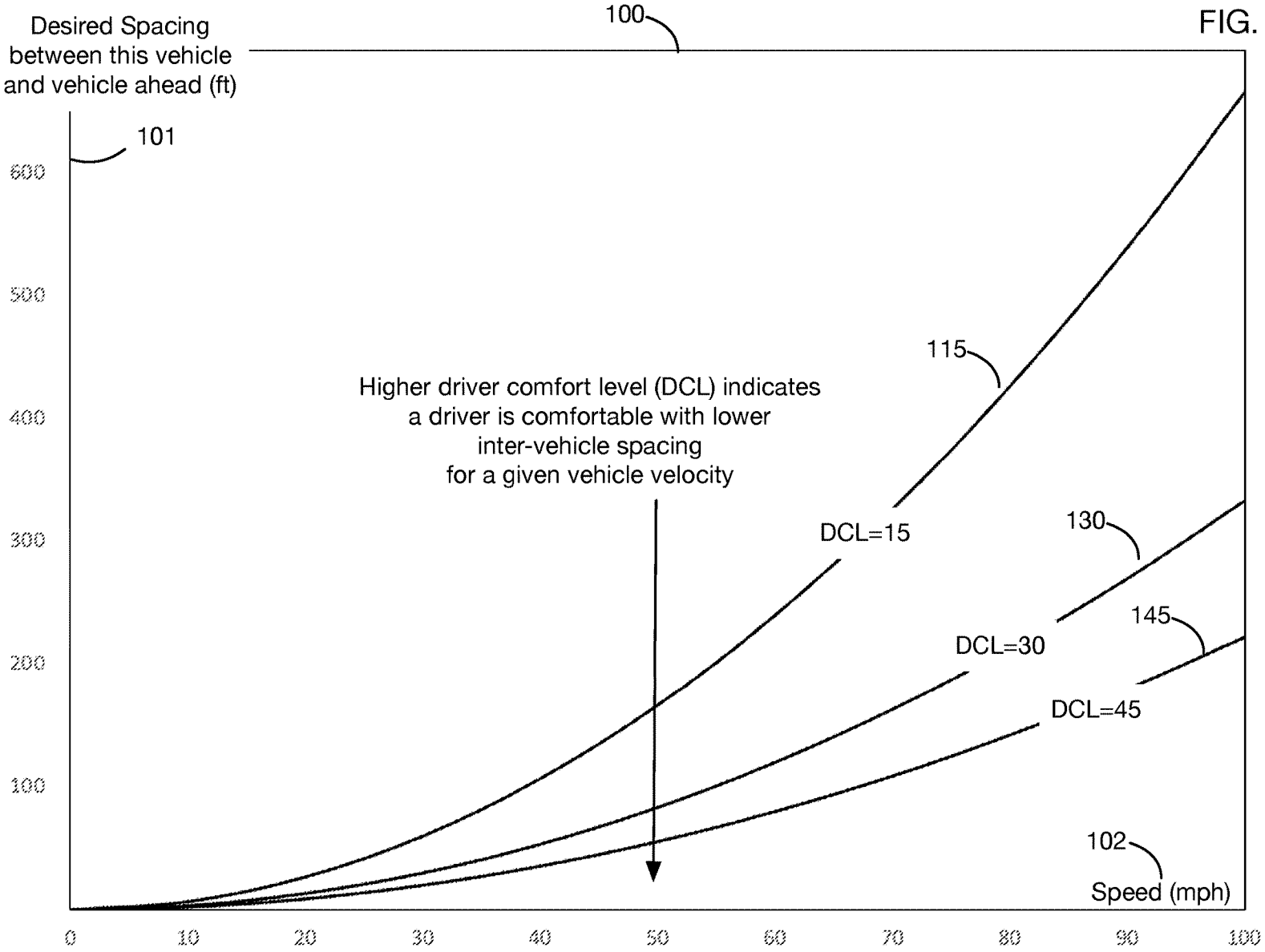
FIG. 1 shows an observed relationship between the velocity of a vehicle and the spacing the driver tries to maintain between his vehicle and the vehicle in front; while this relationship is generally quadratic for most drivers, drivers differ in their driver comfort levels (DCLs), which determine how much space is desired at each velocity.

The dynamics of freeway traffic and the conditions that lead to traffic jams are greatly affected by the relationships between vehicle velocities and the inter-vehicle spacing that drivers attempt to maintain at different speeds. Most drivers realize that braking distance increases as vehicle velocity increases, and they increase their following distances accordingly at higher speeds. Empirically many drivers display a quadratic relationship between the velocity of their vehicle and the spacing between their vehicle and the next vehicle ahead of them on a freeway, as shown in FIG. 1. This quadratic relationship, where spacing is proportional to the square of the vehicle velocity, may reflect drivers' intuitive understanding that the vehicle's kinetic energy increases with the square of its velocity, and that the braking distance needed to bring the vehicle to a stop is therefore also proportional to the square of the velocity. However, drivers differ substantially in how conservative they are in setting their following distances to the vehicle immediately ahead of them. A driver's desired following distance may be based on vehicle technical characteristics such as the vehicle's weight and braking force, and on whether the vehicle has automated assistance to detect a slowdown of the vehicle ahead and automatically apply braking. It may also be based on the driver's knowledge of the vehicle's capabilities; for example, some drivers may be unaware of the vehicle's automated assistance features and may therefore set following distances higher than the distances that are technically necessary.

In this application we use the term "driver comfort level" (DCL) to represent a general relationship between vehicle velocity and inter-vehicle spacing for an individual driver. An illustrative DCL may be defined for example as: DCL=(Vehicle Velocity)$^2$/(Inter-vehicle Spacing). For a driver that follows a quadratic relationship between spacing and velocity, the spacing at a given velocity is therefore: Inter-vehicle Spacing=(1/DCL)*(Vehicle Velocity)$^2$. This illustrative DCL is therefore the inverse of the proportionality factor between squared velocity and spacing. A driver with a higher DCL is comfortable with a smaller inter-vehicle spacing at any given velocity than is a driver with a lower DCL. The DCL factor represents the combined effects of automotive hardware technology, software technology in the form of electronic assistance, and the individual driver's awareness of these technologies, including his/her perception of the safety provided by the technologies. The specific formula for driver DCL given above is illustrative; any definition of DCL that measures how comfortable a specific driver is with smaller inter-vehicle spacing as a function of velocity is in keeping with the spirit of the invention.

FIG. 1 shows graph 100 with three illustrative curves 115, 130, and 145 for three illustrative drivers with DCLs of 15, 30, and 45, respectively, where these DCLs are measured in units of mph$^2$/ft. (One or more embodiments may measure and use DCL values in any desired units.) Each curve shows the desired spacing 101 for the driver between the driver's vehicle and the vehicle immediately ahead, as a function of the vehicle's velocity 102. Drivers with higher DCLs require less spacing at a given velocity; for example, at a velocity of 50 mph, a driver with a DCL of 45 requires an inter-vehicle spacing of 56 feet, while a driver with a DCL of 15 requires an inter-vehicle spacing of 167 feet. For all drivers, regardless of their DCL, spacing increases with the square of the velocity.

Figure 2:
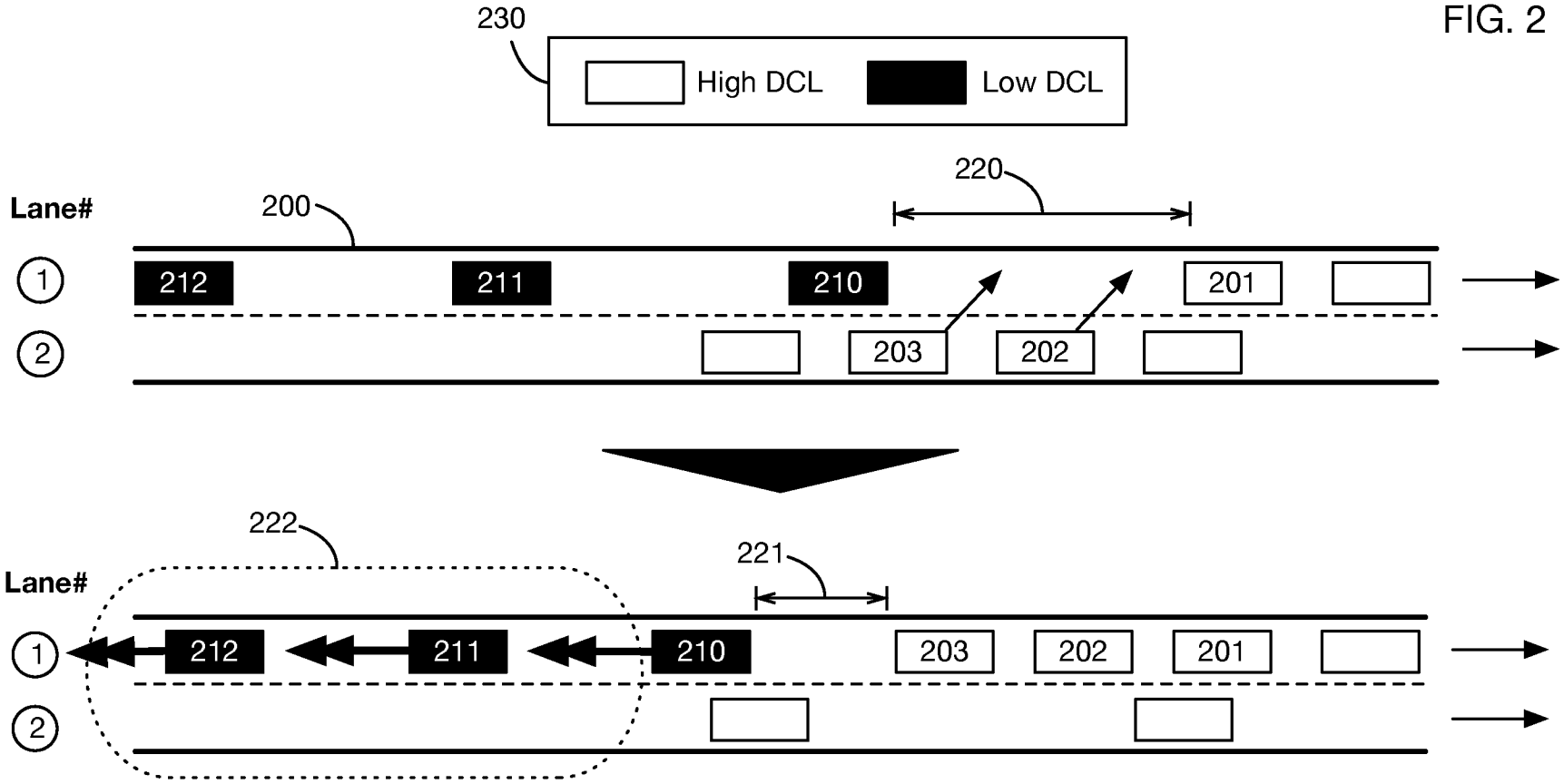
FIG. 2 shows how mixing vehicles with different DCLs on the same lane can lead to traffic jams, for example when high-DCL drivers try to occupy the space in front of a low-DCL driver.

The inventor's analysis of traffic flow and traffic jams indicates that mixing drivers with substantially different DCLs on the same traffic lane can create conditions that lead to traffic jams. An example scenario illustrating this problem is shown in FIG. 2. A two-lane highway 200 has a mix of high-DCL vehicles (shown as white rectangles) and low-DCL vehicles (shown as black rectangles) (refer to legend 230). Initially in the snapshot shown at the top of FIG. 2, a high DCL vehicle 201 in lane 1 is followed by three low DCL vehicles 210, 211, and 212. Vehicle 210 establishes a large following distance 220 between it and vehicle 201, consistent with the low DCL of this vehicle. In adjacent lane 2, two high DCL vehicles 202 and 203 are following closely behind another vehicle. These vehicles 202 and 203 observe the large gap 220 in lane 1, and because they are high-DCL vehicles, they are comfortable moving from lane 2 into lane 1 to occupy this gap. The snapshot shown at the bottom of FIG. 2 shows the consequences of vehicles 202 and 203 moving into this gap in lane 1. Low-DCL vehicle 210 is not comfortable with the reduced following distance 221 when vehicles 202 and 203 occupy gap 220, and therefore vehicle 210 brakes heavily to decelerate to increase its following distance. This sudden deceleration of vehicle 210 then reduces the gap between vehicle 210 and vehicle 211, which causes vehicle 211 to decelerate; this in turn causes vehicle 212 to decelerate. This chain reaction may continue and may lead to the formation of a traffic jam 222. The traffic flow that was stable in the top snapshot has now become unstable due to the movement of a high-DCL vehicle into a gap in front of a low-DCL vehicle.

Figure 3:
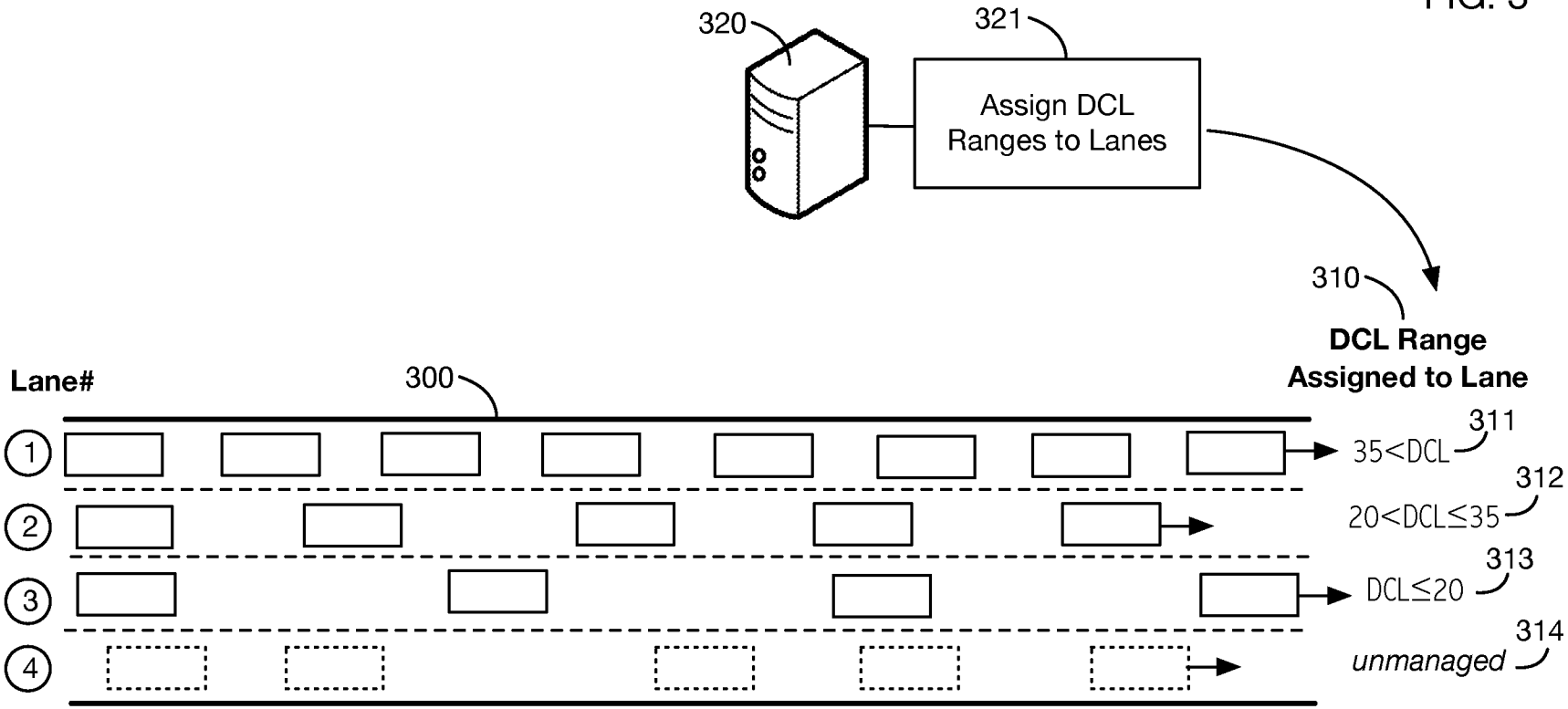
FIG. 3 shows how one or more embodiments of the invention prevent the situation of FIG. 2 by assigning specific non-overlapping DCL ranges to each lane.

The inventor has discovered that a solution to the traffic jam formation situation illustrated in FIG. 2 is to prevent or reduce mixing of vehicles with substantially different DCLs in the same lane. When lanes contain exclusively or primarily vehicles with similar DCLs, traffic flow stability is improved, and the likelihood of traffic jams is greatly reduced. FIG. 3 illustrates this approach for a 4-lane highway 300. This highway has 4 lanes in each direction (with only the lanes of one direction shown in FIG. 3). Embodiments of the invention may be used with any multi-lane roadway of any type, and with roadways having any number of lanes. A processor (or any collection of processors) 320 may perform an assignment 321 of DCL ranges to some or all of the lanes of highway 300. To prevent the type of traffic jam formation scenario illustrated in FIG. 2, the DCL ranges assigned to different lanes may be non-overlapping, so that each DCL value is assigned only one lane. FIG. 3 shows illustrative DCL ranges 310 for lanes 1 through 3 of highway 300. (Lanes are numbered starting from the center of the road closest to the median.) In this example, range 311 containing the highest DCL vehicles is assigned to lane 1 (closest to the center), range 312 with moderate DCL vehicles is assigned to lane 2, and range 313 with the lowest DCL vehicles is assigned to lane 3. In this example, lane 4 is unmanaged by processor 320, so lane 4 may contain a mix of vehicles with different DCLs; for example, vehicles whose DCL has not been measured may drive in lane 4, and lane 4 may also be used for vehicles entering and exiting the highway. In one or more embodiments of the invention any subset of the lanes of a roadway may have DCL ranges assigned, and any number of other lanes may be unmanaged. As in FIG. 3, in one or more embodiments the DCL ranges for lanes closer to the center (such as lane 1) may be higher than the DCL ranges for lanes further from the center (such as lane 3). The DCL ranges 310 are illustrative; in one or more embodiments of the invention any DCL ranges may be assigned to any lanes.

Processor or processors 320 may perform any type of analyses to determine the DCL ranges 310 assigned to the lanes of the highway. For example, the ranges assigned to each lane may be based on the distribution of vehicle DCL values on the freeway, and on traffic conditions at any point in time. DCL ranges assigned to lanes may change over time as traffic conditions change.

Figure 4:
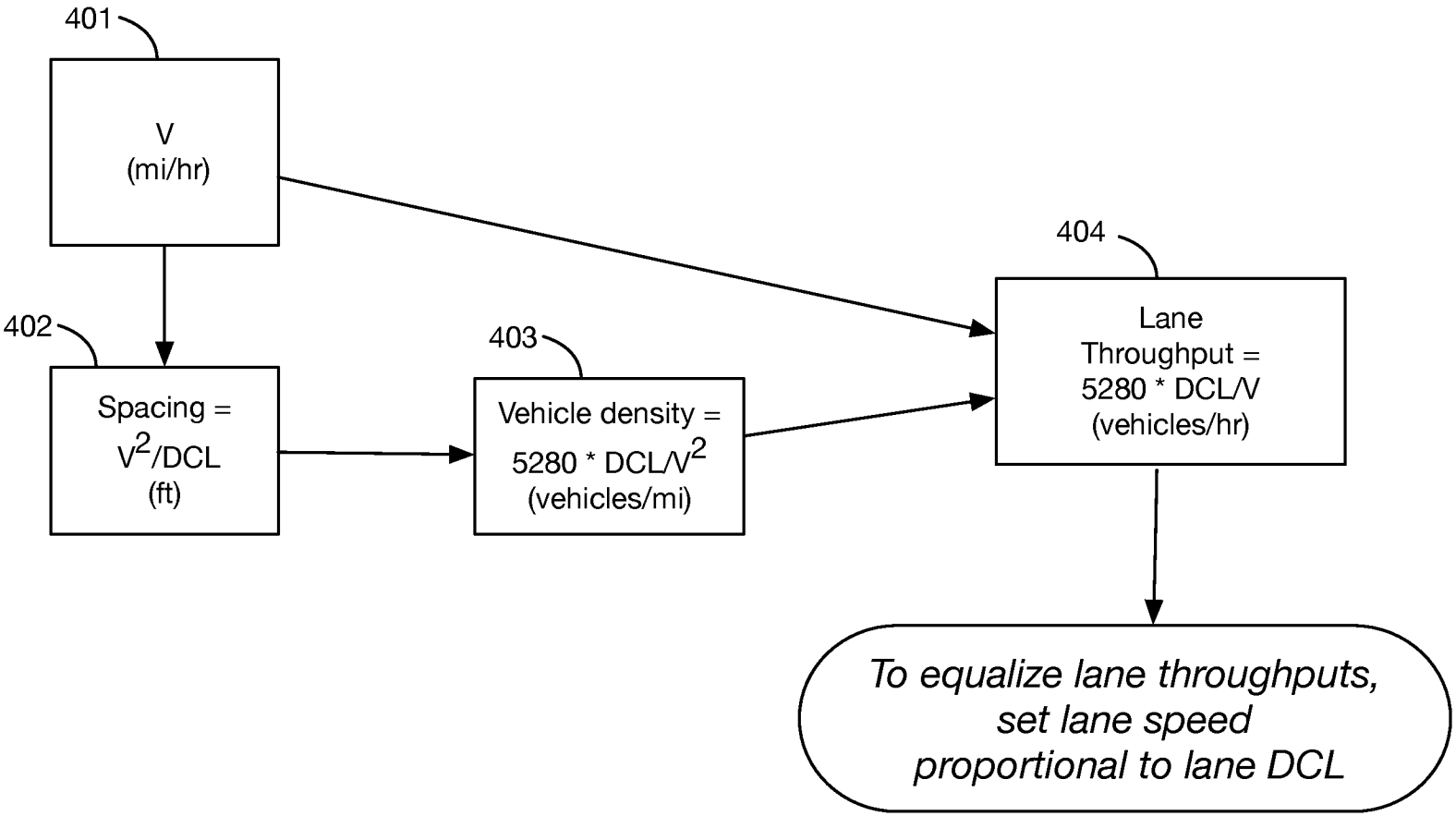
FIG. 4 illustrates the relationship between lane throughput and DCL, and it shows that lane throughputs can be equalized across lanes if vehicles on higher-DCL lanes travel at higher velocities.

In one or more embodiments of the invention, processor 320 may also assign target velocities to each managed lane of a roadway. Traffic flow may be improved if all vehicles in a lane move at approximately the same velocity, for example. However, different lanes may have different target velocities. In one or more embodiments, lanes with higher DCLs may for example be assigned higher velocities. This approach may have two potential benefits. First, the prospect of traveling at a higher velocity (thereby shortening travel time) may encourage drivers to increase their DCL. Second, assigning higher velocities to higher DCL lanes may equalize traffic throughput across lanes, as shown in FIG. 4. As illustrated in FIG. 4, the spacing 402 between vehicles on a lane equals the square of velocity 401 divided by the DCL of vehicles on the lane (which may be an average across the assigned DCL range for the lane, for example). The density 403 of vehicles in the lane is the inverse of the spacing 402 (rescaled by factor 5280 to express density in vehicles per mile.) Lane throughput 404 is the product of lane velocity 401 and vehicle density 403, and is therefore proportional to DCL/V. This expression implies that the vehicle throughput of different lanes will be equal if vehicle velocities on each lane are proportional to the DCL assigned to the lane.

Figure 5:
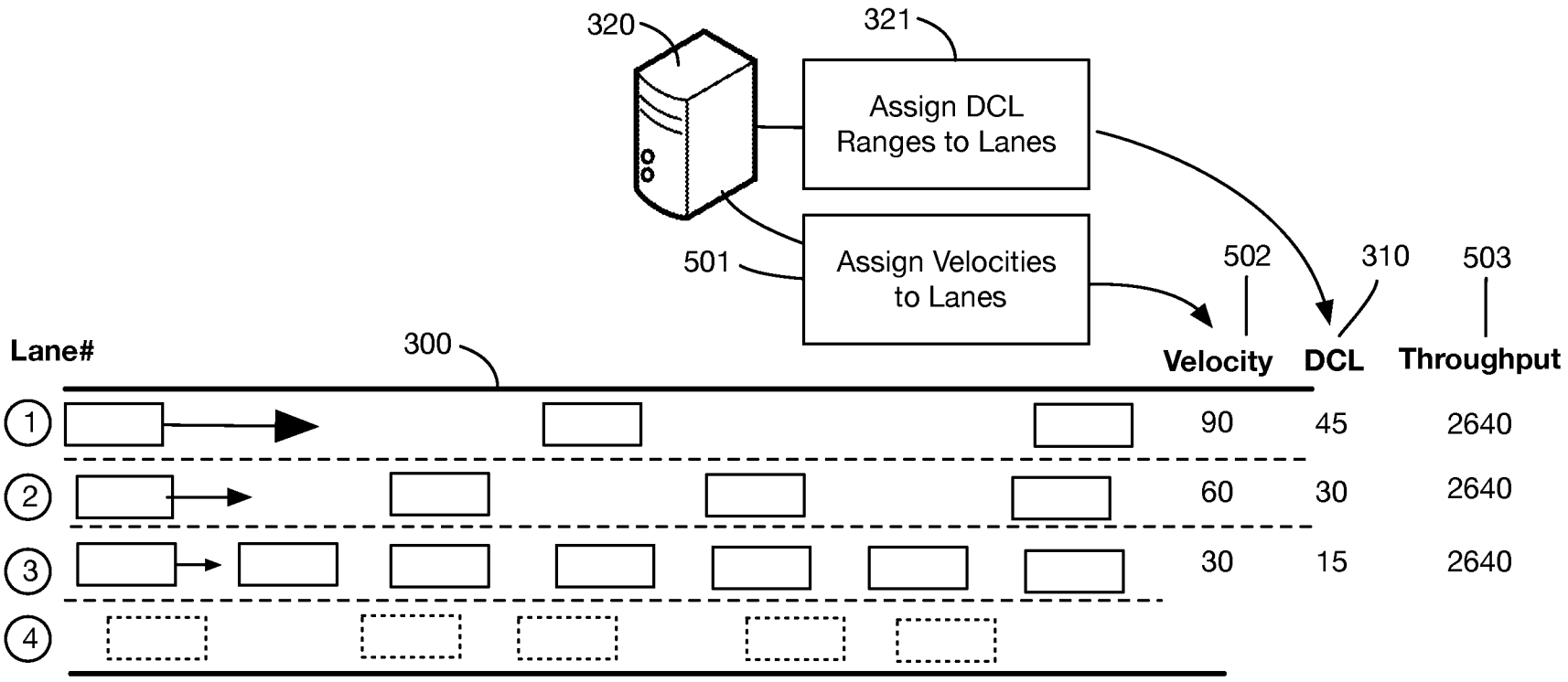
FIG. 5 shows an extension of the embodiment of FIG. 3 that assigns lane velocities in addition to lane DCL ranges.

In an illustrative embodiment shown in FIG. 5, processor 320 performs both DCL assignment 321 and velocity assignment 501 for lanes 1 through 3 of highway 300. For simplicity of exposition, the DCL 310 assigned to each lane is shown as a single value; in practice the DCL for a lane may be a range of values. In this example the velocity 502 assigned to each lane is proportional to the DCL, as described above with respect to FIG. 4; therefore lane 1 contains vehicles with the highest DCLs, and these vehicles travel at the highest velocities. Throughput 503 is equalized across lanes 1 through 3 by assigning velocities proportional to DCLs. In one or more embodiments the processor 320 may assign lane velocities but may not make these velocities strictly proportional to lane DCLs. Embodiments that assign lane velocities may set the velocity of any lane to any value and may assign velocities to any subset of the lanes of a multi-lane roadway. Lanes closer to the center of the roadway (such as lane 1) may be assigned higher velocities in one or more embodiments.

Figure 6:
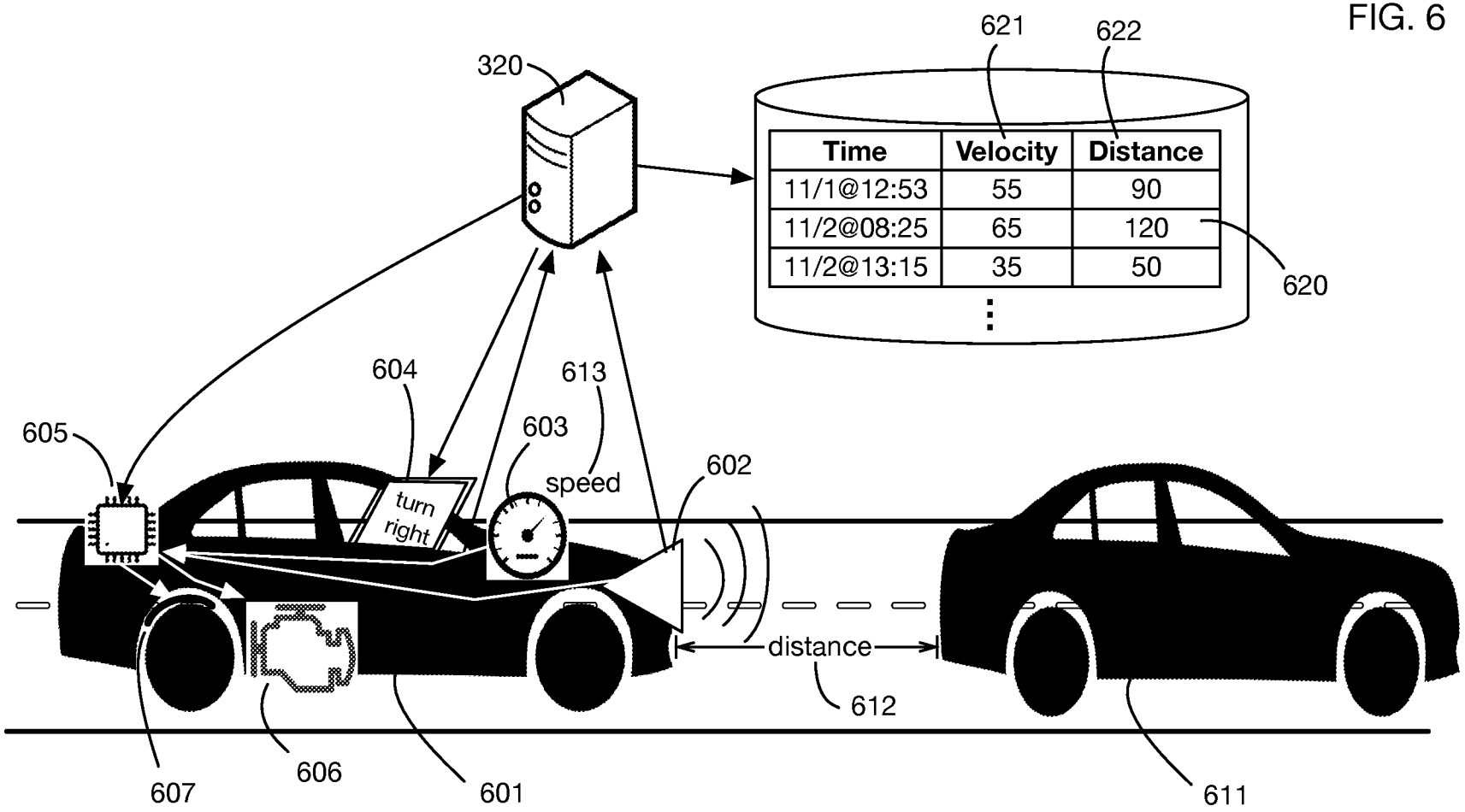
FIG. 6 illustrates communication between a processor (or collection of processors) and sensor and control systems in a vehicle; the processor obtains sample pairs of vehicle velocities and following distances from the vehicle's speed and distance sensors, respectively.

We now describe how one or more embodiments of the invention may interact with vehicles to determine a vehicle's DCL and to accomplish assignment of the vehicle to a specific lane based on its DCL. As illustrated in FIG. 6, processor 320 (or one or more processors of a collection of processors) may interact with one or more sensors or control systems in a vehicle 601. The processor or processors may be connected via one or more network connections to the vehicle subsystems, for example. Network connections may be wireless, wired, or any combination. In one or more embodiments processor 320 may communication for example with onboard vehicle computers that in turn are connected to the various vehicle subsystems. In one or more embodiments a collection of processors 320 may also include processors embedded in one or more vehicles, and some or all of the calculations or actions performed by processors 320 may be performed by in-vehicle processors. Illustrative sensors on vehicle 601 may include a speedometer 603 that measures the vehicle's velocity 613, and a distance sensor 602 that measures the following distance 612 between the front of the vehicle and the back of a vehicle 611 immediately in front of vehicle 601 on a roadway. Processor 320 may obtain data captured from these sensors while vehicle 601 is moving on one or more roadways, and it may store sample data pairs with measured velocities 621 and corresponding measured following distances 622 in a database 620. The velocity and distance data 620 may be used to calculate a vehicle's DCL, as described below.

In one or more embodiments processor 320 may also communicate with a vehicle navigation system 604. This navigation system may for example have a screen or an audio output that communicates with the driver of the vehicle to provide instructions on where and how to navigate. In one or more embodiments the vehicle may be autonomous or semi-autonomous, and the navigation system may directly control the movement of the vehicle without driver interaction. In one or more embodiments processor 320 may also communication a vehicle cruise control system 605 that may for example interact with the vehicle's engine 606 and brakes 607 to maintain the speed of the vehicle at a setpoint value.

Figure 7:
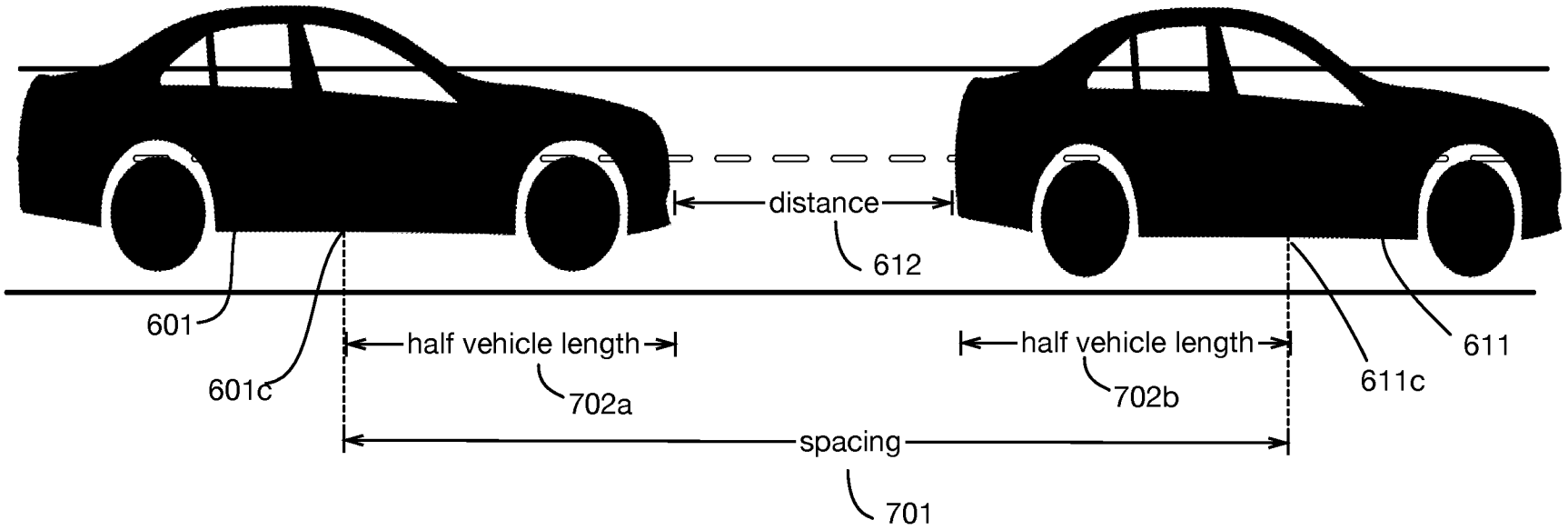
FIG. 7 shows how vehicle following distance may be converted to inter-vehicle spacing (measured for example between vehicle centers) in one or more embodiments of the invention.
Figure 8:
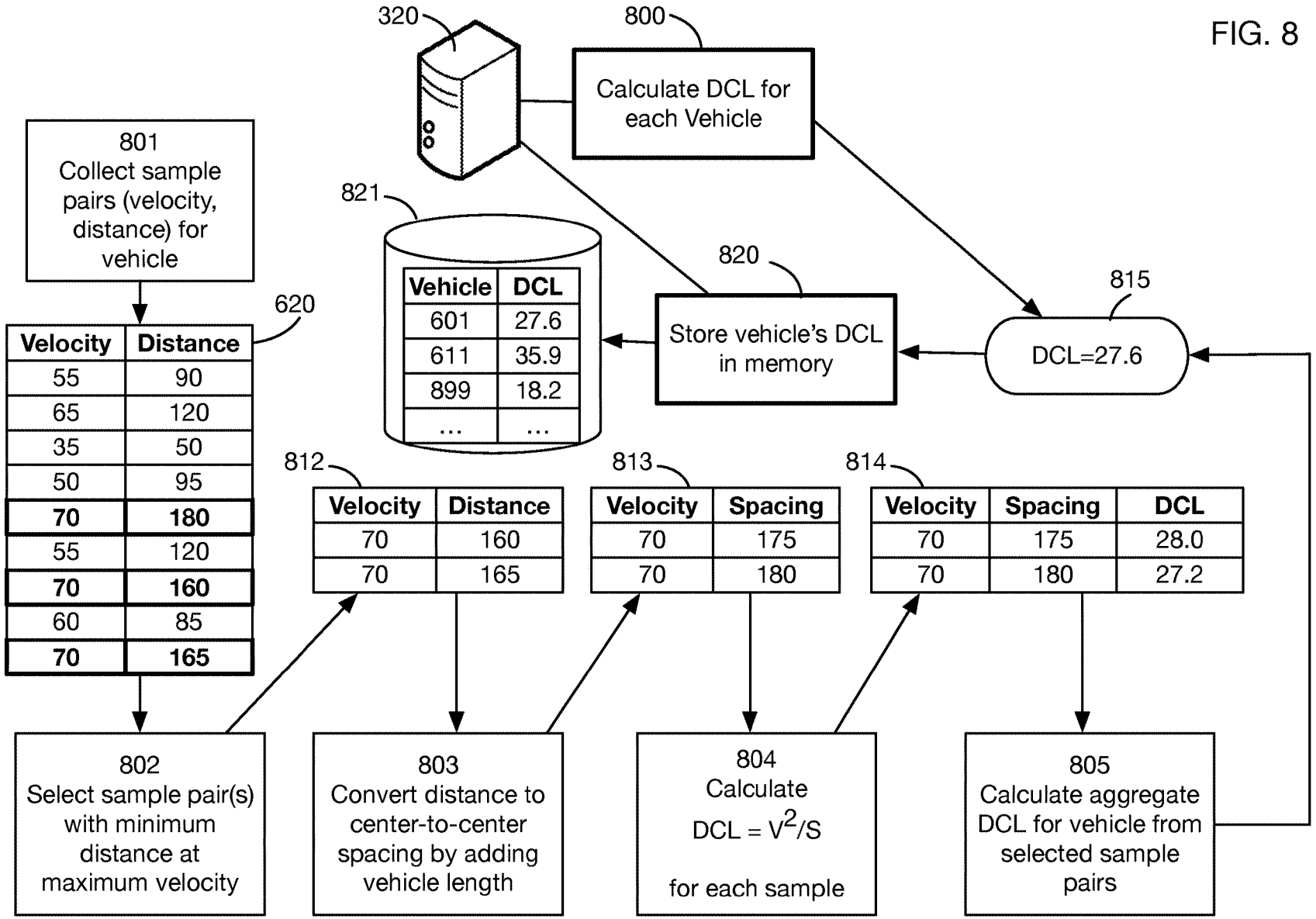
FIG. 8 shows illustrative steps that may be performed to calculate a vehicle DCL from the velocity and distance sample pairs of FIG. 6.

FIG. 7 and FIG. 8 illustrate a method that may be used in one or more embodiments to calculate a vehicle's DCL from sample velocity and following distance data 620. As shown in FIG. 7, in one or more embodiments the following distance information captured from the vehicle sensor(s) may first be converted into inter-vehicle spacing data. The spacing 701 between vehicles 601 and 611 may be defined for example as the distance between vehicle centers 601*c* and 611*c*. The inter-vehicle spacing 701 equals the following distance 612 plus the offsets 702*a* and 702*b* between the ends of the vehicles and the centers of the vehicles. For uniform vehicle lengths, the sum of these offsets equals the length of the vehicle. Therefore, in one or more embodiments the inter-vehicle spacing may be derived from the following distance by adding a vehicle length (either an actual length or an estimated average vehicle length) to the following distance.

FIG. 8 shows illustrative steps that may be used by processor or processors 320 in one or more embodiments to perform calculation 800 of a DCL for each vehicle for which velocity and distance data has been captured. In one or more embodiments the DCL calculations may be performed by multiple processors, including for example by processors integrated into some or all of the vehicles. Step 801 of collecting sample data pairs 620 with velocity and following distance is described above with respect to FIG. 6. A vehicle's DCL or a range of DCLs may be calculated using this data 620. In one or more embodiments the primary focus of the traffic jam avoidance system may be the vehicle's best (highest) DCL at high speeds. Therefore, a selection 802 may be performed to select a subset 812 of velocity/distance sample pairs that correspond to high velocities and low distances. This selection may be based on any desired criteria. For example, sample data pairs may be selected with velocity higher than some threshold and following distance below some threshold. In one or more embodiments the samples with maximum velocities (or with a range of the maximum velocities) may be selected, and then a further subset may be selected from those samples with the smallest following distances. In the example shown in FIG. 8, two sample data pairs 812 are selected from data 620. Step 803 then converts following distance data to inter-vehicle spacing, as described with respect to FIG. 7, resulting in velocity and spacing data pairs 813. Step 804 then calculates the DCL as a ratio of squared velocity to spacing for each of the selected velocity/spacing pairs, resulting in a set of one or more DCL values 814. If there are multiple values in DCL data 814, step 805 may aggregate the DCL values into a single DCL estimate 815 for the vehicle. Aggregation may for example use an average, a median, a maximum, or any other function applied to data 814. In step 820, processor 320 may store the vehicle's calculated DCL in a memory 821, along with an identifier of the vehicle. Memory 821 may be a database coupled to the processor, or it may be distributed within each vehicle, where each vehicle stores its own associated DCL.

Figure 9:
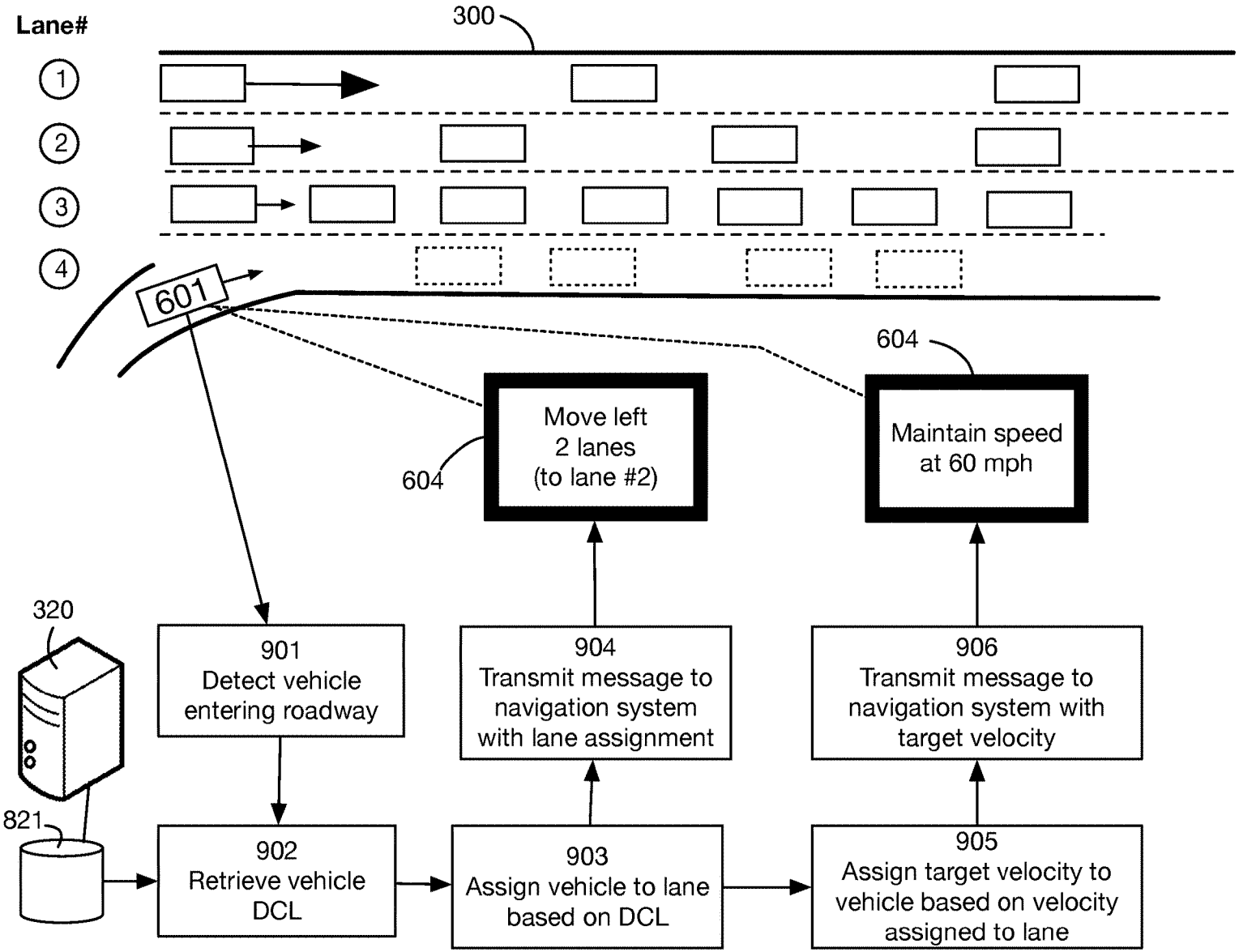
FIG. 9 illustrates how a processor may transmit messages to the navigation system of a vehicle to move the vehicle to its assigned lane based on its DCL, and potentially to also set the vehicle's target velocity based on the assigned lane.

FIG. 9 illustrates how one or more embodiments may use the DCLs calculated for each vehicle to implement the assignment of vehicles to lanes based on DCL values. As described above with respect to FIG. 3 and FIG. 5, lanes 1 to 3 of freeway 300 are assigned DCL ranges and may also potentially be assigned target velocities in one or more embodiments. Processor 320 (which may the same processor as the processor that calculates DCLs and assigns lane DCLs, or it may be one or more additional processors that manage roadway traffic) first performs or obtains a detection 901 that a vehicle 601 is entering roadway 300. This detection may be based for example on location tracking of the vehicle, or may for example occur when a receiver on or near the roadway receives a message from the vehicle. Processor 320 then performs retrieval 902 of the DCL associated with vehicle 601 from the database or other memory 821. Based on the vehicle's DCL and on the DCL ranges assigned to one or more lanes of the roadway, the processor then performs assignment 903 of vehicle 601 to a specific lane. To accomplish the lane assignment, processor 320 may for example perform transmission 904 of a message to the navigation system of the vehicle indicating which lane the vehicle should move to. This message may for example be shown on a display 604 of the vehicle's navigation system, or an audio message may be played for the driver. For an autonomous vehicle the message may direct the vehicle to move to the desired lane. For an embodiment that also assigns target velocities to one or more lanes, processor 320 may also perform assignment 905 of a target velocity to vehicle 601 based on the lane to which the vehicle is assigned. Transmission 906 of a second message to navigation system 604 may inform the vehicle of its assigned target velocity. In one or more embodiments the messages with lane assignment and target velocity may be combined into a single transmission.

Figure 10:
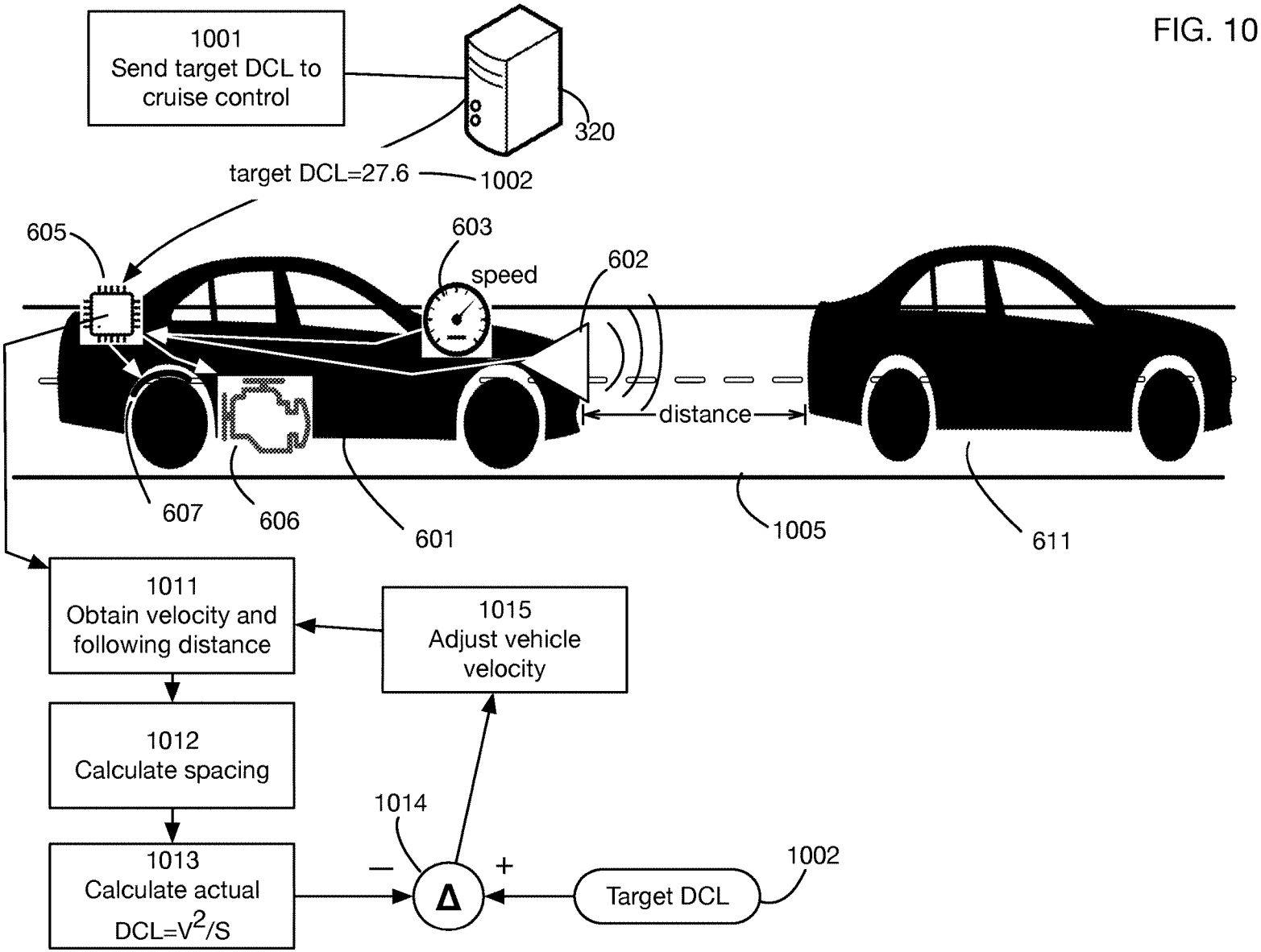
FIG. 10 shows how one or more embodiments of the invention may interact with a vehicle's cruise control system to set a target DCL for the vehicle.

In one or more embodiments of the invention, the DCL of a vehicle may be input into the vehicle's cruise control system, and the cruise control system may then modify the vehicle's velocity to maintain the desired DCL. This feature may be used on either managed roadways where lanes are assigned DCL ranges (as described above) or on unmanaged roadways. FIG. 10 shows an illustrative example for vehicle 601, which has a cruise control system 605. Processor 320 performs step 1001 to transmit the vehicle's target DCL 1002 to the cruise control system 605. (In one or more embodiments the vehicle control system may already have access to the vehicle's target DCL 1002, and it may directly set the DCL of the cruise control system.) Cruise control system 605 may then execute a feedback control loop to adjust the vehicle's velocity so that the actual DCL is within a desired range near the target DCL. Illustrative repeated steps of this control loop may include step 1011 to obtain the vehicle's velocity and following distance from speedometer 603 and distance sensor 602, step 1012 to calculate the inter-vehicle spacing from the following distance, step 1013 to calculate the vehicle's actual DCL as the square of the velocity divided by the spacing, step 1014 to calculate the difference between the actual DCL and the target DCL 1002, and step 1015 to adjust the vehicle's velocity (by transmitting commands to the engine 606 or brakes 607) based on this difference. One or more embodiments may use any desired feedback control algorithm or steps to adjust the vehicle's velocity based on the target DCL 1002.

While the invention herein disclosed has been described by means of specific embodiments and applications thereof, numerous modifications and variations could be made thereto by those skilled in the art without departing from the scope of the invention set forth in the claims.

What is claimed is:

1. A traffic jam avoidance system that assigns vehicles to lanes based on driver comfort levels, comprising: one or more processors coupled via a network to a multiplicity of vehicles, wherein each vehicle of said multiplicity of vehicles comprises a velocity sensor that measures a velocity of said each vehicle; a distance sensor that measures a following distance between said each vehicle and another vehicle immediately in front of said each vehicle; and, a navigation system configured to provide navigation messages to said vehicle; a memory coupled to said one or more processors; wherein said one or more processors are configured to collect sample data pairs from said each vehicle while said each vehicle is moving on one or more roadways, wherein each sample data pair of said sample data pairs comprises said velocity from said velocity sensor, and said following distance from said distance sensor; calculate a driver comfort level for said each vehicle from said sample data pairs, wherein said calculate said driver comfort level for said each vehicle comprises select at least one sample data pair of said sample data pairs that represents a minimum following distance at a maximum velocity: calculate a vehicle spacing for said at least one sample data pair as said following distance plus a vehicle length; and, calculate said driver comfort level as a square of said velocity divided by said vehicle spacing for said at least one sample data pair; and store said driver comfort level for said each vehicle in said memory coupled to said one or more processors; and, wherein said one or more processors are further configured to manage lane assignments on a multi-lane road based on said driver comfort levels, wherein said manage said lane assignments comprises assign a driver comfort level range to two or more lanes of said multi-lane road, wherein driver comfort level ranges of different lanes of said two or more lanes do not overlap; for each vehicle of said multiplicity of vehicles that is moving on said multi-lane road, retrieve the driver comfort level associated with said each vehicle from said memory; select an assigned lane of said two or more lanes with an associated driver comfort level range that contains said driver comfort level associated with said each vehicle; transmit a message to said navigation system of said each vehicle; and, control said each vehicle to drive in said assigned lane.

2. The traffic jam avoidance system that assigns vehicles to lanes based on driver comfort levels of claim 1, wherein said manage said lane assignments further comprises assign higher driver comfort level ranges to lanes closer to a center of said multi-lane road.

3. The traffic jam avoidance system that assigns vehicles to lanes based on driver comfort levels of claim 2, wherein said one or more processors are further configured to assign a lane velocity to said two or more lanes of said multi-lane road.

4. The traffic jam avoidance system that assigns vehicles to lanes based on driver comfort levels of claim 3, wherein said one or more processors are further configured to assign a higher lane velocity to lanes with higher associated driver comfort level ranges.

5. The traffic jam avoidance system that assigns vehicles to lanes based on driver comfort levels of claim 3, wherein said one or more processors are further configured to transmit a second message to said navigation system of said each vehicle instructing said each vehicle to drive at said lane velocity associated with said assigned lane.

6. The traffic jam avoidance system that assigns vehicles to lanes based on driver comfort levels of claim 1, wherein said each vehicle of said multiplicity of vehicles further comprises a cruise control system configured to obtain said velocity from said velocity sensor;

obtain said following distance from said distance sensor;

calculate said vehicle spacing as said following distance plus said vehicle length;

receive a target driver comfort level from said one or more processors;

calculate an actual driver comfort level as a ratio of said velocity squared to said vehicle spacing; and, adjust said velocity of said each vehicle to maintain said actual driver comfort level within a range based on said target driver comfort level.

7. A traffic jam avoidance system that assigns vehicles to lanes based on driver comfort levels, comprising:

one or more processors coupled via a network to a multiplicity of vehicles, wherein each vehicle of said multiplicity of vehicles comprises a velocity sensor that measures a velocity of said each vehicle;

a distance sensor that measures a following distance between said each vehicle and another vehicle immediately in front of said each vehicle; and, a navigation system configured to provide navigation messages to said vehicle;

a memory coupled to said one or more processors;

wherein said one or more processors are configured to collect sample data pairs from said each vehicle while said each vehicle is moving on one or more roadways, wherein each sample data pair of said sample data pairs comprises said velocity from said velocity sensor, and said following distance from said distance sensor;

calculate a driver comfort level for said each vehicle from said sample data pairs; and store said driver comfort level for said each vehicle in said memory coupled to said one or more processors; and, wherein said one or more processors are further configured to manage lane assignments on a multi-lane road based on said driver comfort levels, wherein said manage said lane assignments comprises assign a driver comfort level range to two or more lanes of said multi-lane road, wherein driver comfort level ranges of different lanes of said two or more lanes do not overlap;

for each vehicle of said multiplicity of vehicles that is moving on said multi-lane road, retrieve the driver comfort level associated with said each vehicle from said memory;

select an assigned lane of said two or more lanes with an associated driver comfort level range that contains said driver comfort level associated with said each vehicle; and, transmit a message to said navigation system of said each vehicle instructing said each vehicle to drive in said assigned lane;

wherein said each vehicle of said multiplicity of vehicles further comprises a cruise control system configured to obtain said velocity from said velocity sensor;

obtain said following distance from said distance sensor;

calculate a vehicle spacing as said following distance plus a vehicle length;

receive a target driver comfort level from said one or more processors;

calculate an actual driver comfort level as a ratio of said velocity squared to said vehicle spacing; and, adjust said velocity of said each vehicle to maintain said actual driver comfort level within a range based on said target driver comfort level.

8. The traffic jam avoidance system that assigns vehicles to lanes based on driver comfort levels of claim 7, wherein said calculate said driver comfort level for said each vehicle comprises select at least one sample data pair of said sample data pairs that represents a minimum following distance at a maximum velocity;

calculate said vehicle spacing for said at least one sample data pair as said following distance plus said vehicle length; and, calculate said driver comfort level as a square of said velocity divided by said vehicle spacing for said at least one sample data pair.

9. The traffic jam avoidance system that assigns vehicles to lanes based on driver comfort levels of claim 7, wherein said manage said lane assignments further comprises assign higher driver comfort level ranges to lanes closer to a center of said multi-lane road.

10. The traffic jam avoidance system that assigns vehicles to lanes based on driver comfort levels of claim 9, wherein said one or more processors are further configured to assign a lane velocity to said two or more lanes of said multi-lane road.

11. The traffic jam avoidance system that assigns vehicles to lanes based on driver comfort levels of claim 10, wherein said one or more processors are further configured to assign a higher lane velocity to lanes with higher associated driver comfort level ranges.

12. The traffic jam avoidance system that assigns vehicles to lanes based on driver comfort levels of claim 10, wherein said one or more processors are further configured to transmit a second message to said navigation system of said each vehicle instructing said each vehicle to drive at said lane velocity associated with said assigned lane.

* * * * *